US011033787B2

(12) United States Patent
Daraskavich et al.

(10) Patent No.: US 11,033,787 B2
(45) **Date of Patent: *Jun. 15, 2021**

(54) GOLF IRONS WITH SEALED UNDERCUT

(71) Applicant: KARSTEN MANUFACTURING CORPORATION, Phoenix, AZ (US)

(72) Inventors: Matt Daraskavich, Grapevine, TX (US); Brian J. Kammerer, Fort Worth, TX (US); Michael Pinto, Fort Worth, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/718,628

(22) Filed: Dec. 18, 2019

(65) Prior Publication Data

US 2020/0122002 A1 Apr. 23, 2020

Related U.S. Application Data

(63) Continuation of application No. 16/058,884, filed on Aug. 8, 2018, now Pat. No. 10,561,910, which is a continuation of application No. 14/708,709, filed on May 11, 2015, now Pat. No. 10,071,291.

(51) Int. Cl.
*A63B 53/04* (2015.01)
*A63B 60/54* (2015.01)

(52) U.S. Cl.
CPC ..... *A63B 53/0475* (2013.01); *A63B 53/0408* (2020.08); *A63B 60/54* (2015.10)

(58) Field of Classification Search
CPC .. A63B 53/0475; A63B 60/54; A63B 53/0408
See application file for complete search history.

(56) References Cited

U.S. PATENT DOCUMENTS

| | | | |
|---|---|---|---|
| 2,846,228 | A | 8/1958 | Reach |
| 4,340,230 | A | 7/1982 | Churchward |
| 4,355,808 | A | 10/1982 | Jernigan et al. |
| 4,645,207 | A | 2/1987 | Teramoto et al. |
| 4,824,110 | A | 4/1989 | Kobayashi |
| 4,883,274 | A | 11/1989 | Hsien |
| D320,056 | S | 9/1991 | Antonious |
| 5,048,835 | A | 9/1991 | Gorman |
| 5,074,563 | A | 12/1991 | Gorman |
| 5,082,278 | A | 1/1992 | Hsien |
| D327,308 | S | 6/1992 | Antonious |
| 5,290,032 | A | 3/1994 | Fenton et al. |
| 5,290,036 | A | 3/1994 | Fenton et al. |
| 5,328,184 | A | 7/1994 | Antonious |
| 5,447,311 | A | 9/1995 | Viollaz et al. |
| 5,492,327 | A | 2/1996 | Biafore, Jr. et al. |
| 5,586,947 | A | 12/1996 | Hutin |
| 5,588,923 | A | 12/1996 | Schmidt et al. |

(Continued)

OTHER PUBLICATIONS

U.S. Appl. No. 66/093,112, filed Jul. 25, 2000, Peters et al.

*Primary Examiner* — William M Pierce

(57) ABSTRACT

A golf club head includes a body, a first polymeric insert, and a second polymeric insert. The body includes a face, a sole, and a rear wall that collectively define an undercut volume. The first polymeric insert is provided within the undercut volume to define a sealed cavity within the undercut volume; and, the second polymeric insert is secured to the body and defines an open cavity extending from the rear wall toward the face.

20 Claims, 3 Drawing Sheets

(56) References Cited

U.S. PATENT DOCUMENTS

| | | | |
|---|---|---|---|
| 5,816,936 | A | 10/1998 | Aizawa et al. |
| 5,899,815 | A | 5/1999 | Helou et al. |
| 5,967,903 | A | 10/1999 | Cheng |
| 6,027,415 | A | 2/2000 | Takeda |
| 6,030,295 | A | 2/2000 | Takeda |
| 6,086,485 | A | 7/2000 | Hamada et al. |
| 6,093,112 | A | 7/2000 | Peters et al. |
| 6,183,376 | B1 | 2/2001 | Peters et al. |
| 6,193,614 | B1 | 2/2001 | Sasamoto et al. |
| 6,358,158 | B2 | 3/2002 | Peters et al. |
| 6,368,231 | B1 | 4/2002 | Chen |
| 6,440,010 | B1 | 8/2002 | Deshmukh |
| 6,482,104 | B1 | 11/2002 | Gilbert |
| D473,606 | S | 4/2003 | Mickelson et al. |
| 6,554,719 | B2 | 4/2003 | Peters et al. |
| 6,592,469 | B2 | 7/2003 | Gilbert |
| D487,127 | S | 2/2004 | Madore |
| 6,811,496 | B2 | 11/2004 | Wahl et al. |
| 6,835,144 | B2 | 12/2004 | Best |
| 6,863,625 | B2 | 3/2005 | Reyes et al. |
| 6,942,580 | B2 | 9/2005 | Hou et al. |
| 6,981,924 | B2 | 1/2006 | Deshmukh |
| 7,004,853 | B2 | 2/2006 | Deshmukh |
| 7,022,031 | B2 | 4/2006 | Nishio |
| 7,025,693 | B2 | 4/2006 | Sugimoto |
| 7,112,148 | B2 | 9/2006 | Deshmukh |
| 7,137,903 | B2 | 11/2006 | Best et al. |
| 7,147,571 | B2 | 12/2006 | Best et al. |
| 7,186,188 | B2 | 3/2007 | Gilbert et al. |
| 7,192,361 | B2 | 3/2007 | Gilbert et al. |
| 7,192,362 | B2 | 3/2007 | Gilbert et al. |
| 7,232,377 | B2 | 6/2007 | Gilbert et al. |
| 7,273,418 | B2 | 9/2007 | Gilbert et al. |
| 7,371,190 | B2 | 5/2008 | Gilbert et al. |
| 7,485,049 | B2 | 2/2009 | Gilbert et al. |
| 7,559,850 | B2 | 7/2009 | Gilbert et al. |
| 7,614,962 | B1 | 11/2009 | Clausen |
| 7,621,822 | B2 | 11/2009 | Roach |
| 7,662,050 | B2 | 2/2010 | Gilbert et al. |
| 7,686,704 | B2 | 3/2010 | Gilbert et al. |
| 7,731,604 | B2 | 6/2010 | Wahl et al. |
| 7,789,771 | B2 | 9/2010 | Park et al. |
| 7,803,062 | B2 | 9/2010 | Gilbert et al. |
| 7,819,757 | B2 | 10/2010 | Soracco et al. |
| 7,942,760 | B2 | 5/2011 | Best et al. |
| 8,033,927 | B2 | 10/2011 | Gilbert et al. |
| 8,088,025 | B2 | 1/2012 | Wahl et al. |
| 8,182,359 | B2 | 5/2012 | Gilbert et al. |
| 8,197,354 | B2 | 6/2012 | Gilbert et al. |
| 8,202,174 | B2 | 6/2012 | Breier et al. |
| 8,235,833 | B2 | 8/2012 | Best et al. |
| 8,298,095 | B2 | 10/2012 | Gilbert et al. |
| 8,328,663 | B2 | 12/2012 | Wahl et al. |
| 8,353,785 | B2 | 1/2013 | Ines et al. |
| 8,366,566 | B1 | 2/2013 | Rollinson |
| 8,403,771 | B1 | 3/2013 | Rice et al. |
| 8,475,293 | B2 | 7/2013 | Morin et al. |
| 8,480,507 | B2 | 7/2013 | Finn et al. |
| 8,512,164 | B2 | 8/2013 | Ines et al. |
| 8,517,863 | B2 | 8/2013 | Wahl et al. |
| 8,535,176 | B2 | 9/2013 | Bazzel et al. |
| 8,715,105 | B2 | 5/2014 | Stites et al. |
| 8,758,159 | B2 | 6/2014 | Morin et al. |
| 8,777,776 | B2 | 7/2014 | Wahl et al. |
| 8,814,725 | B2 | 8/2014 | Wahl et al. |
| 8,834,292 | B2 | 9/2014 | Tsuji et al. |
| 8,876,630 | B2 | 11/2014 | Takechi |
| 8,911,301 | B1 | 12/2014 | Allen |
| 8,911,302 | B1 | 12/2014 | Ivanova et al. |
| 8,920,258 | B2 | 12/2014 | Dolezel et al. |
| 8,920,261 | B2 | 12/2014 | Taylor et al. |
| 8,932,150 | B2 | 1/2015 | Ines et al. |
| 9,044,653 | B2 | 6/2015 | Wahl et al. |
| 9,265,995 | B2 | 2/2016 | Wahl et al. |
| 9,333,400 | B2 | 5/2016 | Girard et al. |
| 9,352,198 | B2 | 5/2016 | Roach et al. |
| 9,675,852 | B2 | 6/2017 | Westrum |
| 9,718,119 | B2 | 8/2017 | Zimmerman et al. |
| 2007/0178988 | A1 | 8/2007 | Tavares et al. |
| 2007/0293343 | A1 | 12/2007 | Lai et al. |
| 2008/0020861 | A1 | 1/2008 | Adams et al. |
| 2012/0157222 | A1 | 6/2012 | Kii |
| 2012/0289360 | A1 | 11/2012 | Breier et al. |
| 2013/0017904 | A1 | 1/2013 | Woolley et al. |
| 2013/0252754 | A1 | 9/2013 | Bazzel et al. |
| 2013/0344988 | A1 | 12/2013 | Hettinger et al. |
| 2013/0344989 | A1 | 12/2013 | Hebreo et al. |
| 2014/0073447 | A1 | 3/2014 | Golden et al. |
| 2014/0248977 | A1 | 9/2014 | Morin et al. |
| 2014/0302944 | A1 | 10/2014 | Roach et al. |
| 2015/0328506 | A1 | 11/2015 | Morales et al. |
| 2016/0144248 | A1 | 5/2016 | Chen et al. |
| 2016/0184669 | A1 | 6/2016 | Deshmukh et al. |

GOLF IRONS WITH SEALED UNDERCUT

CROSS REFERENCE SECTION

This is a continuation of U.S. patent application Ser. No. 16/058,884, filed on Aug. 8, 2018, which is a continuation of U.S. patent application Ser. No. 14/708,709, filed May 11, 2015, which is now U.S. Pat. No. 10,071,291, the content of which are fully incorporated herein by reference.

TECHNICAL FIELD

The present invention relates generally to an iron-type golf club head with a sealed undercut.

BACKGROUND

A golf club may generally include a club head disposed on the end of an elongate shaft. During play, the club head may be swung into contact with a stationary ball located on the ground in an effort to project the ball in an intended direction and with a desired vertical trajectory.

Many design parameters must be considered when forming a golf club head. For example, the design must provide enough structural resilience to withstand repeated impact forces between the club and the ball, as well as between the club and the ground. The club head must conform to size requirements set by different rule setting associations, and the face of the club must not have a coefficient of restitution above a predefined maximum (measured according to applicable standards). Assuming that certain predefined design constraints are satisfied, a club head design for a particular loft can be quantified by the magnitude and location of the center of gravity, as well as the head's moment of inertia about the center of gravity and/or the shaft.

The club's moment of inertia relates to the club's resistance to rotation (particularly during an off-center hit), and is often perceived as the club's measure of "forgiveness." In typical club designs, high moments of inertia are desired to reduce the club's tendency to push or fade a ball. Achieving a high moment of inertia generally involves moving mass as close to the perimeter of the club as possible (to maximize the moment of inertia about the center of gravity), and as close to the toe as possible (to maximize the moment of inertia about the shaft). In iron-type golf club heads, this desire for increased moments of inertia have given rise to designs such as the cavity-back club head and the hollow club head.

While the moment of inertia affects the forgiveness of a club head, the location of the center of gravity behind the club face (and above the sole) generally affects the trajectory of a shot for a given face loft angle. A center of gravity that is positioned as far rearward (away from the face) and as low (close to the sole) as possible typically results in a ball flight that has a higher trajectory than a club head with a center of gravity placed more forward and/or higher.

While a high moment of inertia is obtained by increasing the perimeter weighting of the club head or by moving mass toward the toe, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

In the tension between swing speed (mass) and forgiveness (moment of inertia), it may be desirable to place varying amounts of mass in specific locations throughout the club head to tailor a club's performance to a particular golfer or ability level. In this manner, the total club head mass may generally be categorized into two categories: structural mass and discretionary mass.

Structural mass generally refers to the mass of the materials that are required to provide the club head with the structural resilience needed to withstand repeated impacts. Structural mass is highly design-dependent, and provides a designer with a relatively low amount of control over specific mass distribution. On the other hand, discretionary mass is any additional mass that may be added to the club head design for the sole purpose of customizing the performance and/or forgiveness of the club. In an ideal club design, the amount of structural mass would be minimized (without sacrificing resiliency) to provide a designer with a greater ability to customize club performance, while maintaining a traditional or desired swing weight.

Specifically as to iron designs, discretionary mass is typically placed as far from the shaft as possible (i.e., toward the toe portion), as far from the face as possible (i.e., to the rear of the head), and as low as possible. This tends to provide a club head having a high moment of inertia (forgiveness) and a generally higher launch angle.

SUMMARY

A golf club head includes a body, a first polymeric insert, and a second polymeric insert. The body includes a face, a sole, and a rear wall that collectively define an undercut volume. The first polymeric insert is provided within the undercut volume to define a sealed cavity within the undercut volume; and, the second polymeric insert is secured to the body and defines an open cavity extending from the rear wall toward the face.

In one configuration, the first polymeric insert is operative to restrict fluid access to the undercut volume. The first polymeric insert may be in compression between the face and the rear wall and may be adhered about its perimeter to the face and rear wall.

The normal projection of the open cavity onto the face defines a first area, and the normal projection of the undercut volume onto the face defines a second area. In one configuration these areas do not overlap, and may be in a ratio of from about 0.7:1 to about 1.3:1. Additionally, the projection of the sealed cavity onto the face may define a third area, and the ratio of the first area to the third area may be from about 0.9:1 to about 2.0:1. In one configuration, the first area is from about 800 $mm^2$ to about 1600 $mm^2$.

The above features and advantages and other features and advantages of the present technology are readily apparent from the following detailed description when taken in connection with the accompanying drawings.

DETAILED DESCRIPTION

Figure 1:
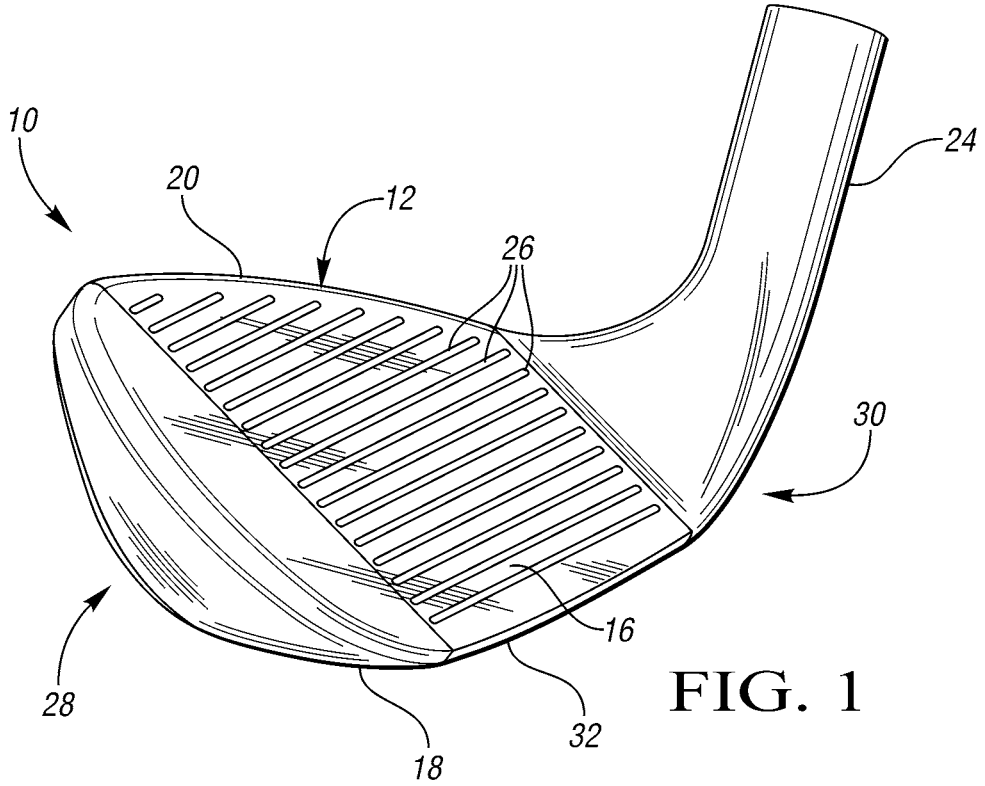
FIG. 1 is a schematic perspective view of the face of an iron-type golf club head.
Figure 2:
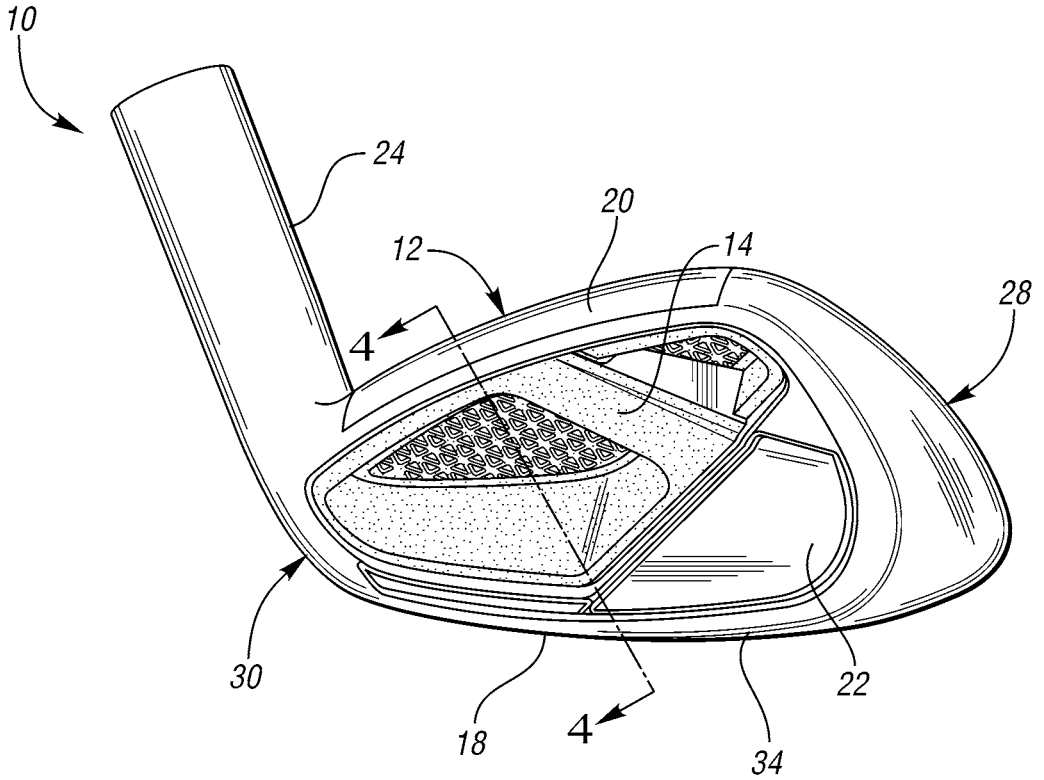
FIG. 2 is a schematic perspective view of the rear wall of an iron-type golf club head.

Referring to the drawings, wherein like reference numerals are used to identify like or identical components in the various views, FIGS. 1 and 2 schematically illustrate a golf club head 10 including a body 12 and a polymeric insert 14. In the illustrated embodiment, the body 12 includes a face 16, sole 18, topline 20, rear wall 22, and hosel 24.

The club face 16 is intended to contact the golf ball during a normal swing, and includes a plurality of parallel grooves 26 that are recessed into a hitting surface of the club face 16 in a generally concave manner. As is commonly understood, the club face 16 is angled (relative to a vertical plane) when the golf club is held in a neutral hitting position. This angle is generally referred to as the loft angle or slope of the club. Wood-type club heads (including hybrid woods) may most commonly have loft angles of from about 8.5 degrees to about 24 degrees, while iron-type club heads may most commonly have loft angles from about 17 degrees to about 64 degrees, though other loft angles are possible and have been commercially sold. A particular subset of iron-type club heads, referred to as "wedges," generally have loft angles of from about 44 degrees to about 64 degrees. The present technology may be of particular importance to iron-type club heads, and more specifically to wedges.

The sole 18 may extend on an underside of the club head 10 such that the sole 18 contacts the ground or a horizontal ground plane when the golf club is held in a neutral hitting position. The sole 18 may extend from a toe portion 28 of the club head 10 to a heel portion 30 of the club head 10, and may be disposed between the club face 16 and the rear wall 22. In general, the sole 18 may transition into the face at a leading edge 32 and may transition into the rear wall at a trailing edge 34.

While the sole 18 may generally define the underside of the club head 10, the topline 20 may generally define the upper or top portion of the club head 10. The topline 20 provides structural support or reinforcement for the club face 16. In general, the sole 18 and topline 20 are disposed on opposing sides of both the club face 16 and the rear wall 22.

Figure 3:
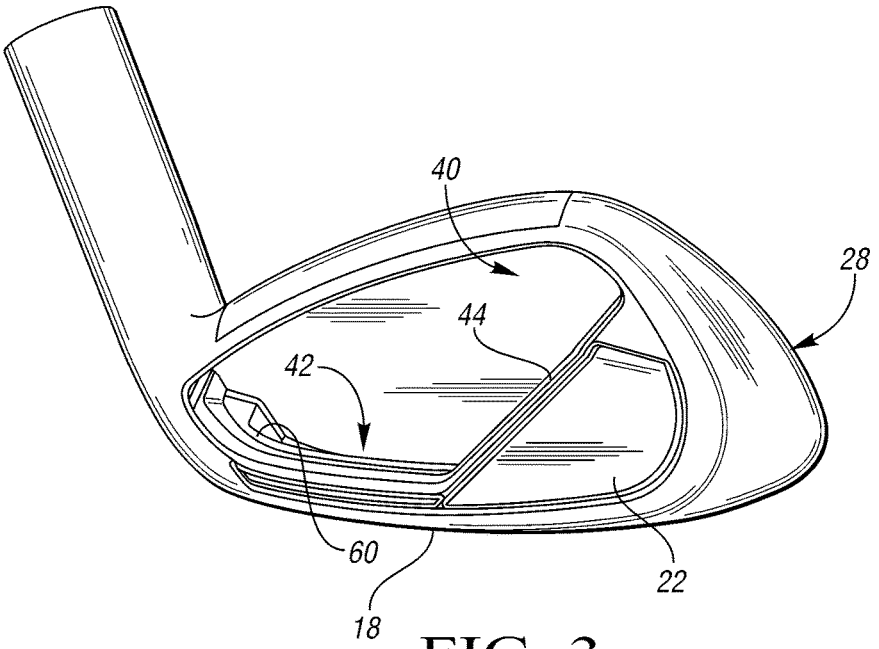
FIG. 3 is a schematic perspective view of the rear portion of a body of an iron-type golf club head.

As shown in FIG. 3, in an effort to shift the center of mass closer to the sole 18, toe 28, and/or rear wall 22, the present design removes a portion of the rear wall 22 to define an opening 40 and removes material between the rear wall 22 and the face 16 to define an undercut volume 42. In the present design, the threshold of the undercut volume 42 is defined by one or more of the following: an imaginary surface that is normal to the club face 16 and in contact with an edge of the opening 40; an imaginary surface that is extrapolated from a threshold surface 44 of the opening 40 provided in the rear wall 22 to the face 16; or by a surface 46 of the polymeric insert 14 that extends between the rear wall 22 and the face 16.

Figure 4:
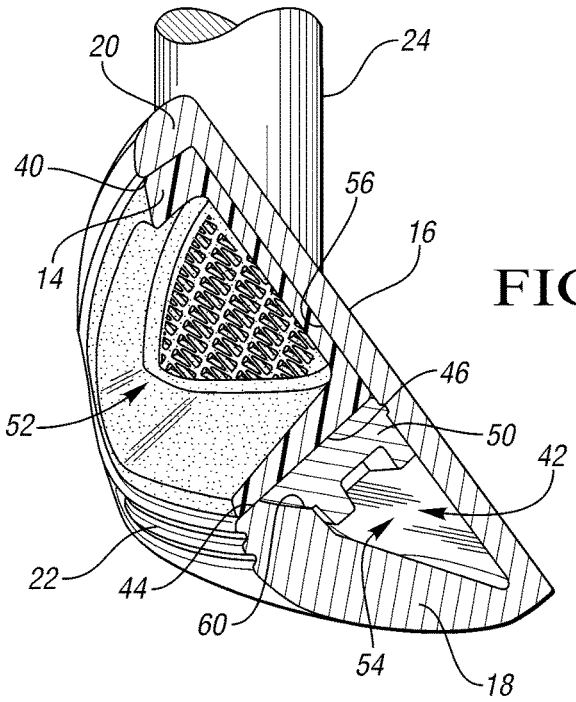
FIG. 4 is a schematic cross-sectional view of the golf club head FIG. 2, taken along line 4-4.

As best illustrated in FIG. 4, the present club head 10 employs a dual-cavity design that is formed, in part by the first, exposed polymeric insert 14, as well as by a second, concealed polymeric insert 50. In this design, the first polymeric insert 14 is secured to the body 12 to define a first, open cavity 52. The open cavity 52 includes a concave recess that is open to the external environment and extends from the opening 40 provided in the rear wall 22 toward the face 16.

The second polymeric insert 50 is provided within the undercut volume 42 to form a second, sealed cavity 54. The sealed cavity 54 is an entirely enclosed portion of the undercut volume 42 and is defined between the second polymeric insert 50 and the body 12 (e.g., the face 16, the sole 18, and the rear wall 22).

In one embodiment, the first polymeric insert 14 is adhered to a rear surface 56 of the face 16, similar to a medallion. In this design, where the insert 14 extends from the rear wall 22, the construction of the first polymeric insert 14 disguises/hides the existence of the undercut volume 42. To some consumers, this is an advantageous quality since the design allows the club to have performance benefits attributable to an undercut volume, without the undercut being outwardly visible.

If the design only consisted of the first polymeric insert 14 and the body 12, with the insert 14 only being secured to the face 16, any clearance between the insert 14 and the rear wall 22 may allow liquid to enter the undercut volume 42 where it might become temporarily trapped. If this occurred, for example, while cleaning the club just prior to a shot, the trapped fluid may be difficult to drain out, and may alter the swing weighting of the club head 10.

To overcome possible trapped fluid issues, the second polymeric insert 50 may be positioned at the threshold of the undercut volume 42 such that it is operative to restrict fluid access into the undercut volume 42. In one configuration, this sealing effect may occur by forming the insert 50 from a sufficiently elastic material and placing it in compression between the face 16 and the rear wall 22. For example, the second insert 50 may be formed from a polymer that has a hardness, measured on the Shore A scale, of from about 40A to about 60A. In another configuration, the sealing effect may occur by adhering the insert 50 to the body 12 around a perimeter of the insert 50.

The second polymeric insert 50 may further be operative to support the face 16 and rear wall 22. In this manner, the insert 50 may dampen vibrations following an impact and/or may stiffen the body 12 to increase one or more of the modal frequencies of the club head 10.

In one configuration, the second insert 50 may be maintained in position at the threshold of the undercut volume 42 by one or more retaining features provided in the body 12. Examples of potential retaining features may include posts, ledges, or sloped walls, where the feature is operative to restrain the insert 50 from entering the undercut volume 42 by more than a predefined distance. In the example provided in FIGS. 3 and 4, the retaining feature includes a ledge 60 that interferes with the insert's ability to enter the undercut volume 42 any more than shown (in FIG. 4). If the second insert 50 is adhered in place, it may likewise be adhered to the retaining feature.

Figure 5:
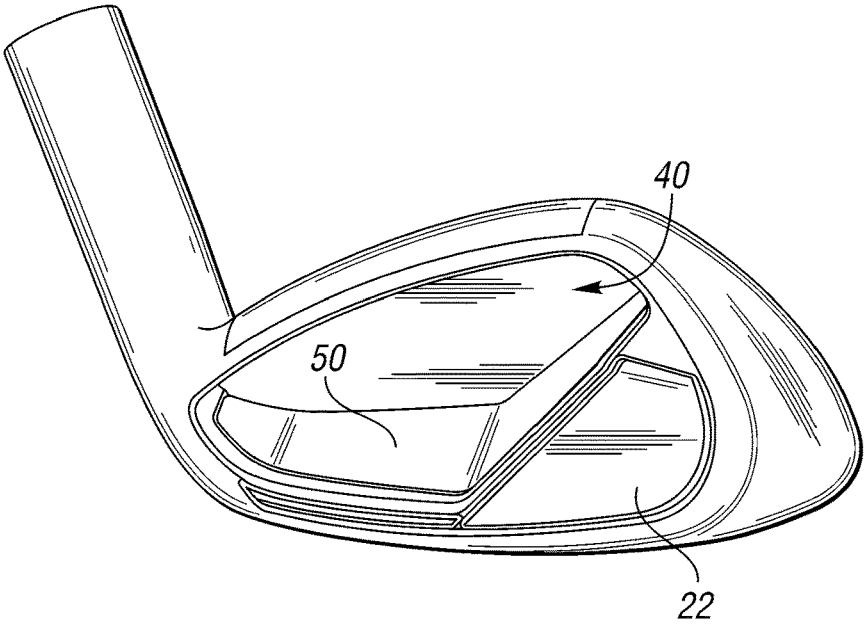
FIG. 5 is a schematic perspective view of the body of an iron-type golf club head, including a sealed undercut volume.

FIG. 5 illustrates the second insert 50 installed within the body such that it is flush with the threshold of the undercut volume 42. Once installed, the first insert 14, (e.g., shown in FIG. 6) may be slid into place through the opening 40 and secured. Because the first insert 14 is exposed to the external environment and extends to the rear wall 22, it is desirably made from a polymer that is sufficiently hard and durable such that it can withstand minor impacts. For example, the first insert 14 may be formed from a polymeric material that has a hardness, measured on the Shore D scale, of from about 75D to about 90D, or more preferably from about 80D to about 90D.

Figure 7:
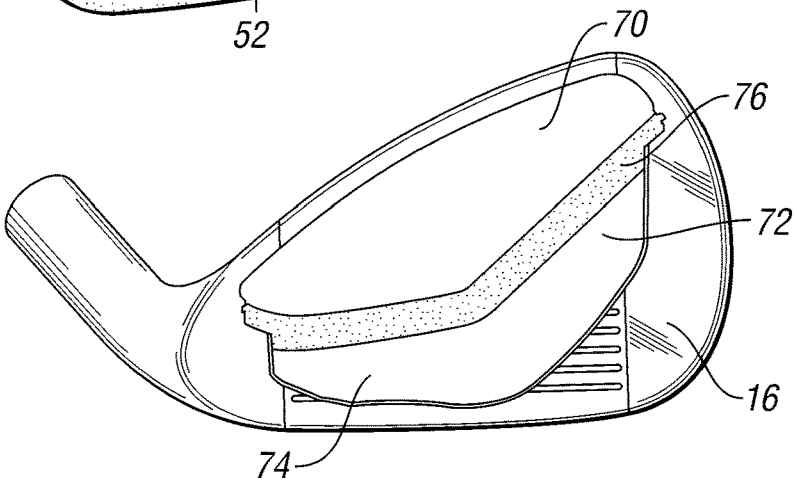
FIG. 7 is a schematic view of the normal projection of a dual cavity structure onto the face of a golf club head.

The present design may include a sufficiently large hidden undercut volume 42 to cause a meaningful movement of the center of gravity of the club head 10. When viewed normal to the face 16, the undercut volume 42 and open cavity 52 may be similarly sized. More specifically, in one configuration such as shown in FIG. 7, a normal projection of the open cavity 52 onto the face 16 may define a first area 70, and the normal projection of the undercut volume 42 may define a second area 72 (i.e., where the second area 72 includes the projection 74 of the sealed cavity 54 and the projection 76 of the second polymeric insert 50). The ratio of the first area 70 to the second area 72 may be from about 0.7:1 to about 1.3:1, or from about 0.8:1 to about 1.2:1, or even from about 0.9:1 to about 1.1:1. Additionally, the size of the first area 70 may be from about 800 $mm^2$ to about 1600 $mm^2$. In one embodiment, the areas 70, 72 do not overlap.

While it may be possible to entirely fill the undercut volume 42 with polymer, the weight savings provided by a hollow, sealed cavity 54 may enable additional mass to be moved toward the toe 28, sole 18, and or/rear wall 22. As such, the ratio of the first area 70 to the area of the projection 74 of the sealed cavity 54 may be from about 0.9:1 to about 2.0:1, or from about 1.1:1 to about 1.9:1. Such ratios may further benefit the design from a structural/acoustic perspective by causing the second polymeric insert 50 to extend across a central region of the face 16 and/or behind a designed impact zone.

Figure 6:
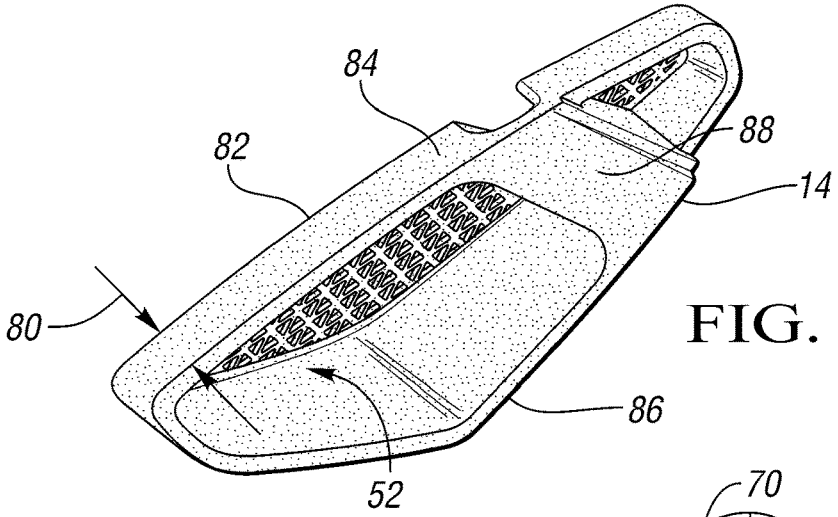
FIG. 6 is a schematic perspective view of a polymeric insert.

Referring to FIG. 6, the exposed first insert 14 may define the open cavity 52 and may have a varying width 80 around its perimeter (i.e., where width is measured normal to the face 16, or to the surface 82 of the insert 14 that is intended to be positioned in contact with, or parallel to the face 16). For example, the variable width 80 may be within the range of from about 2.5 mm to about 6.0 mm along an upper portion 84 that is intended to contact, or be directly adjacent to the topline 20. Conversely, the variable width 80 may be within the range of from about 5.0 mm to about 20 mm along a lower portion 86 that is intended to contact, or be directly adjacent the second insert 50. Regardless of the specific dimension, the variable width 80 should be sufficiently large to extend between the rear wall 22 and the face 16 such that the insert 14 appears to extend from the rear wall 22 and/or could be adhered to the rear wall 22 if so desired.

In one embodiment, the first polymeric insert 14 may be dimensioned such that it is in contact with the body 12 along some or all of the topline 20 and rear wall 22. In such an embodiment, the strength and hardness of the first insert 14 may serve a further reinforcing purpose. Said another way, the first insert 14 may be operative to stiffen the body structure and raise one or more vibrational modes of the club head 10. In this embodiment, design features of the insert 14, such as a reinforcing feature 88 extending across the open cavity 52, may contribute to the stiffening. As shown, the reinforcing feature 88 may be a channel, beam, bar, strut, or the like, and may extend across the cavity 52 between two non-adjacent portions of the insert 14.

To accomplish a structural reinforcement, it is preferable to use a material that has a tensile strength of greater than about 200 MPa (according to ASTM D638), or more preferably greater than about 250 MPa. Additionally, for ease of molding, if the polymeric material of the insert 14 is filled, then it desirably has a resin content of greater than about 50%, or even greater than about 55% by weight. One such material may include, for example, a thermoplastic aliphatic or semi-aromatic polyamide that is filled with chopped fiber, such as chopped carbon fiber or chopped glass fiber. Other materials may include polyimides, polyamide-imides, polyetheretherketones (PEEK), polycarbonates, engineering polyurethanes, and/or other similar materials.

As noted above, the present design removes a substantial amount of structural weight between the rear wall 22 and the face 16, and affords a club designer the ability to place the weight elsewhere in the club head 10 to maximize performance. Additionally, these goals are achieved while maintaining a particular aesthetic appearance that hides the presence of the undercut volume 42 via the use of comparatively light weight polymers.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A cavity-back golf club head for an iron-type golf club, the golf club head comprising:

a club head body including a face, a sole adjoining the face, and a rear wall adjoining the sole, wherein the face, the sole, and the rear wall define an undercut volume, the rear wall including at an upper edge thereof a threshold surface defining an upper threshold of the undercut volume, and a sloped ledge adjoining the threshold surface and projecting at an obtuse angle from the threshold surface into the undercut volume;

a first polymeric insert between a rear surface of the face and the sloped ledge of the rear wall within the undercut volume to thereby define a fluidly sealed empty cavity within the undercut volume; and a second polymeric insert secured to the club head body and including a concave recess defining an open cavity extending from the rear wall toward the face, wherein the first insert includes a top surface and a sloped surface projecting at an obtuse angle from the top surface, the top surface of the first insert being seated against a bottom surface of the second insert, and the sloped surface being seated against the sloped ledge of the rear wall, wherein the second insert includes a reinforcing feature extending across the open cavity; and wherein the first polymeric insert has a resin content of greater than about 50% by weight.

2. The golf club head of claim 1, wherein the top surface of the first insert is flush with the bottom surface of the second insert.

3. The golf club head of claim 1, wherein the first insert is in compression between the rear surface of the face and the sloped ledge of the rear wall.

4. The golf club head of claim 1, wherein a normal projection of the open cavity onto the face defines a first area, and a normal projection of the undercut volume onto the face defines a second area, and wherein the first area and the second area do not overlap.

5. The golf club head of claim 4, wherein a ratio of the first area to the second area is from about 0.7:1 to about 1.3:1.

6. The golf club head of claim 5, wherein the normal projection of the undercut volume includes a normal projection of the sealed cavity onto the face that defines a third area, and wherein a ratio of the first area to the third area is from about 0.9:1 to about 2.0:1.

7. The golf club head of claim 4, wherein the first area is from about 800 $mm^2$ to about 1600 $mm^2$.

8. The golf club head of claim 1, wherein the first insert has a hardness, measured on the Shore A scale, of from about 40A to about 60A.

9. The golf club head of claim 1, wherein the first insert is adhered to the sloped ledge of the rear wall.

10. The golf club head of claim 1, wherein the first polymeric insert has a resin content of greater than about 55% by weight.

11. The golf club head of claim 1, wherein the first insert and second insert are comprised of a polymeric material.

12. The golf club head of claim 1, wherein the first insert is interference fit between the rear surface of the face and the sloped ledge of the rear wall within the undercut volume.

13. The golf club head of claim 1, wherein the reinforcing feature has a tensile strength of greater than about 250 MPa.

14. A golf club head comprising:

a club head body including a face, a sole, and a rear wall, wherein the face, the sole, and the rear wall define an undercut volume, the rear wall including a threshold surface at an upper threshold of the undercut volume, and a sloped ledge adjoined to and projecting at an obtuse angle from the threshold surface;

a first insert interference fit between a rear surface of the face and the sloped ledge of the rear wall within the undercut volume to thereby restrict fluid access to the undercut volume, a second insert secured to the rear surface of the face and extending to the rear wall, wherein the second insert includes a concave recess that defines an open cavity, the second insert trapping the first polymeric insert between the second insert and the sloped ledge of the rear wall, wherein the first insert includes a top surface seated against a bottom surface of the second insert, and a sloped surface projecting at an obtuse angle from the top surface and seated against the sloped ledge of the rear wall, wherein the second insert includes a reinforcing feature extending across the open cavity; and wherein the first polymeric insert has a resin content of greater than about 50% by weight.

15. The golf club head of claim 14, wherein the first insert is in compression between the rear surface of the face and the sloped ledge of the rear wall.

16. The golf club head of claim 14, wherein the reinforcing feature has a tensile strength of greater than about 250 MPa.

17. The golf club head of claim 14, wherein the first insert has a hardness, measured on the Shore A scale, of from about 40A to about 60A.

18. The golf club head of claim 14, wherein the first insert is adhered to the ledge of the rear wall.

19. A club head for an iron-type golf club, the club head comprising:

a club head body including a face, a sole adjoining a bottom end of the face, a rear wall opposite the face and adjoining the sole, and a topline opposite the sole and adjoining a top end of the face, wherein the face, the sole, and the rear wall cooperatively define an undercut volume proximate the sole, the rear wall including at an upper edge thereof a threshold surface defining an upper threshold of the undercut volume, and a sloped ledge adjoined to and projecting at an obtuse angle from the threshold surface into the undercut volume;

a first insert between a rear surface of the face and the sloped ledge of the rear wall, the first insert fluidly sealing the undercut volume, a second insert attached to the club head body adjacent the topline and the face, the second insert defining an open cavity between the topline and the undercut volume, wherein the first insert includes a top surface seated flush against a bottom surface of the second insert, and a sloped surface projecting at an obtuse angle from the top surface and seated flush against the sloped ledge of the rear wall, wherein the second insert includes a reinforcing feature extending across the open cavity; and wherein the first polymeric insert has a resin content of greater than about 50% by weight.

20. The golf club head of claim 19, wherein the reinforcing feature has a tensile strength of greater than about 250 MPa.

* * * * *